United States Patent [19]

Nicoud

[11] 4,042,424

[45] Aug. 16, 1977

[54] ELECTRICAL CONDUCTORS OF ALUMINUM-BASED ALLOYS

[75] Inventor: Jean-Claude Nicoud, Saint-Egreve, France

[73] Assignee: Societe de Vente de l'Aluminium, Paris, France

[21] Appl. No.: 691,009

[22] Filed: May 28, 1976

[30] Foreign Application Priority Data

May 28, 1975 France ..... 75.17201

[51] Int. Cl.[2] ..... C22F 1/04

[52] U.S. Cl. ..... 148/12.7 A; 75/142; 75/147; 148/2; 148/32.5

[58] Field of Search ..... 75/138, 148, 147, 142, 75/143; 148/2, 3, 11.5 A, 32, 32.5, 12.7 A

[56] References Cited

U.S. PATENT DOCUMENTS

| | | | |
|---|---|---|---|
| 3,418,177 | 12/1968 | Pryor | 148/11.5 A |
| 3,770,515 | 11/1973 | Besel | 148/11.5 A |

*Primary Examiner*—R. Dean

*Attorney, Agent, or Firm*—Dennison, Dennison, Meserole & Pollack

[57] ABSTRACT

The invention relates to improved electrical conductors of aluminum-based alloys containing from 0.15 to 0.35% of iron, from 0.30 to 0.70% of silicon, from 0.30 to 0.80% of magnesium, and up to 0.40% of copper. These conductors are obtained by drawing wire rod at a temperature of from 110° to 180° C, followed by artificial aging at a temperature in the range from 130° to 240° C. The invention may be applied in the manufacture of overhead cables for carrying power over long distances.

5 Claims, No Drawings

ELECTRICAL CONDUCTORS OF ALUMINUM-BASED ALLOYS

This invention relates to an improvement in the mechanical and electrical characteristics of aluminum-magnesium-silicon alloys.

Weakly alloyed Al-Mg-Si alloys (magnesium to approximately 1%, Si to approximately 1%) have been used for almost half a century as electrical conductors, especially in the form of overhead cables for carrying power over long distances. The alloy commonly known as "Almelec" or AGS/L (according to French standard A 02 001), which is the subject of French standard AFNOR NF-C-34125, has to adhere to the following minimal characteristics in the case of wires smaller than or equal to 3.6 mm in diameter: minimal ultimate tensile strength — 33 kg/mm$^2$; minimum average for cables — 34.5 kg/mm$^2$; elongation at break — 4%; maximum resistivity at 20° C — 3.28 $\mu\ \Omega$ . cm; maximum average resistivity for cables — 3.25 $\mu\ \Omega$ .cm.

Its chemical composition is of the following order: Mg 0.6%, Si 0.6%, Fe $\leq$ 0.35%.

A significant increase in the mechanical characteristics without any loss of conductivity would be an obvious advantage either with the view to increasing span without modifying the height of the pylons or with a view to obtaining a greater mechanical safety coefficient for the same span.

Now it cannot be hoped to obtain a significant improvement in the mechanical characteristics for a given electrical resistivity by increasing the content of alloying elements (especially Mg and Si) which would be reflected in a reduction in drawability.

It has now been found that it is possible to obtain improved conductor wires of AGS/L by combining: (1) Tepid drawing, i.e. drawing at a temperature in the range from 110° to 180° C and preferably in the range from 130° to 160° C, of the wire rod previously subjected to solution heat treatment and quenching; (2) A slight modification in its chemical composition by the addition of copper in a maximum quantity of 0.40%; (3) An artificial aging treatment after drawing which may be carried out either in a static furnace or, preferably, continuously.

The manufacture of wires of Al-Mg-Si alloys of the AGS/L type for overhead cables may be carried out by various processes. Among these, reference is made in particular to three processes comprising the following series of operations:

First process: rolling square billets or extruding blooms in a press, welding rings of wire rod, drawing to approximately three times the required final diameter, solution heat treatment, quenching, drawing to the final diameter and artificial aging.

Second process: semi-continuous press extrusion of blooms with water quenching at the output end of the press, drawing to the final diameter, artificial aging.

Third process: continuous casting and rolling of wire rod in machines of the Properzi or Secim (formerly Spidem) type, solution heat treatment in a furnace of spools of wire weighing approximately 1 ton, followed by quenching, stoving, drawing to the final diameter and artificial aging.

The last of these processes has been the most commonly used for about twenty years because it has the best productivity level both at the production stage of the wire rod and at the processing stage. It is used for Al-Mg-Si alloys of which the chemical composition may vary from 0.15 to 0.35% for iron, from 0.30 to 0.80% for magnesium, from 0.30 to 0.70% for silicon, the other elements being those generally present in electrical-grade aluminum alloys. This process is also the one which lends itself best to the application of the invention.

It is known among experts in the art that the mechanical characteristics of Al-Mg-Si alloys after solution heat treatment, quenching and artificial aging in the case of sections, or after solution heat treatment, quenching, drawing and artificial aging in the case of wires, may be substantially improved by the addition of copper.

On the other hand, electrical resistivity increases to a significant extent and, so far as the second process mentioned above is concerned, suitability for extrusion is significantly reduced which offsets the practical advantage of such an addition. In addition, the copper content has to be limited in view of the corrosion risk which its presence may involve.

In addition, it is known (cf. French Pat. No. 1,499,266 in the name of Pechiney) that the drawing of wires of Al-Mg-Si alloy, after quenching and aging at a temperature below the rapid precipitation temperature which is of the order of 200° C and above the normal drawing temperatures of from 20° C to 70° C results, in the case of drawing at 110° C, in an increase in the ultimate tensile strength of 1 to 1.5 kg/mm$^2$ for equal resistivity after the final artificial aging/recovery treatment carried out at a temperature of 165° C.

The present invention relates to a process for the production of distinctly improved conductor wires of Al-Mg-Si alloy characterized by combinations of mechanical and electrical characteristics which are distinctly better in terms of performance than those obtained with conventional processes; improved thermal stability and creep strength; a fatigue resistance at least equivalent to that of the prior art.

Accordingly, the process according to the invention comprises adding copper to an Al-Mg-Si alloy (AGS/L or "Almelec") in a quantity not exceeding 0.40% and preferably not exceeding 0.20%, and subjecting the wire rod obtained, for example by the third process described above, to so-called tepid processing by drawing between the solution heat treatment and quenching of the wire and the artificial aging treatment of the drawn wire, these treatments being carried out either in batches in a static furnace or continuously.

The tepid drawing processes carried out in a temperature range corresponding to the low precipitation rates of $Mg_2Si$, a temperature range such as this being from 110° to 180° C in the case of Al-Mg-Si alloys with the following composition: Fe 0.15 - 0.35%, Si 0.30 - 0.70%, Mg 0.30 - 0.80%. Drawing is carried out at these temperatures with an elongation level in excess of 350% $(S - s)/(s) \times 100 \geq 350\%$ (S being the initial section and s the final section of the wire) and surprisingly enables the final characteristics (couples $R - \rho$) obtained after final artificial aging to be improved by virtue of a finer distribution of the hardening $Mg_2Si$ constituents which precipitate during the tepid drawing operation and by virtue of the elimination during the tepid drawing operation of Guinier-Preston zones formed by aging after quenching and contributing significantly towards the electrical resistivity, but only negligibly to structural hardening.

It has surprisingly been found that the combination of the addition of copper in quantities limited to 0.4% and preferably to 0.2% and tepid drawing enables very high final mechanical and electrical property levels to be obtained without any need to use excessive copper contents which would adversely affect both drawability under normal conditions and also corrosion resistance.

In addition, taking into account the effect which it has upon precipitation hardening, tepid drawing enables the drawn wires to be subjected to a continuous artificial aging treatment.

The tepid drawing operation is carried out with wire rod in different ways, i.e. with a spool of cold wire, in which case, the wire is cold on entering the drawing machine or, preferably, is gradually preheated to the tepid drawing temperature, or with a spool of wire preheated in a furnace to a temperature below the tepid drawing temperature and not exceeding 140° C, at which temperature a significant hardening effect is obtained, being reflected in reduced drawability.

One method of carrying out the tepid drawing operation comprises, for example, drawing the wire in a multiple-pass machine with in-line capstans and functioning by immersion, the bath of lubricant being thermostatically controlled to the tepid drawing temperature and the drawing die being sprayed with this same thermostatically controlled lubricant. In this case, the temperature of the lubricant is adjusted to between 110° and 180° C and preferably to between 130° and 160° C in dependence upon the drawing conditions (cold-working level, drawing rate and, hence, drawing time).

After tepid drawing, the wire is heat treated either in a static batch furnace at nominal temperatures in the range from 130° to 170° C for periods ranging from 30 minutes to 12 hours or, preferably, continuously on leaving the tepid drawing arrangement at nominal temperatures in the range from 180° to 240° C over periods ranging from 1 to 30 seconds. One way of carrying out a heat treatment such as this is, for example, to pass the wire continuously through a thermostatically controlled oil bath furnace which also makes it possible to obtain a wire which is perfectly lubricated and, hence, eminently suitable for the subsequent cable-forming operation.

This heat treatment has a recovering effect and also promotes precipitation hardening which is reflected in an increase in electrical conductivity and a restoration of plasticity (elongation and bending), whilst the mechanical strength of the wires (ultimate tensile strength) remains at a high level.

The process according to the invention is illustrated by the following Examples.

EXAMPLE 1

Four alloys A, B, C and D with the following compositions were drawn in a known manner:

| | Fe % | Si % | Cu % | Mg % |
|---|---|---|---|---|
| A | 0.18 | 0.55 | < 0.008 | 0.66 |
| B | 0.18 | 0.57 | 0.05 | 0.70 |
| C | 0.18 | 0.58 | 0.20 | 0.69 |
| D | 0.20 | 0.56 | 0.53 | 0.67 |

The processing cycle was as follows:

a. press extrusion of blooms 100 mm in diameter giving a wire rod 9.5 mm in diameter;
b. solution heat treatment of the 9.5 mm diameter wire rod for three hours at 540° C;
c. quenching with cold water;
d. aging for eight days at ambient temperature;
e. drawing on a single-pass block to a diameter of 2.2 mm at ambient temperature at a rate of 40 meters per minute;
f. final artificial aging in a static furnace at 165° C with residence times ranging from thirty minutes to nine hours.

Tensil strength/resistivity associations were obtained, according to the artificial aging times, for which it is possible to trace curves $R = f(\rho)$. Taking into account only the resistivity value $\rho = 3.25\ \mu\ \Omega$ .cm, the following ultimate tensile strength values were obtained:

| | |
|---|---|
| Alloy A : 36.4 kg/m² | $\rho = 3.25\ \mu\Omega$ . cm |
| B : 36.8 kg/mm² | $\rho = 3.25\ \mu\Omega$ . cm |
| C : 39.5 kg/mm² | $\rho = 3.25\ \mu\Omega$ . cm |
| D : 41.5 kg/mm² | $\rho = 3.25\ \mu\Omega$ . cm |

EXAMPLE 2

Composition of the alloy Fe 0.30%, Si 0.60%, Mg 0.64%, Cu 0.015%.

Processing cycle:

a. casting, followed by continuous rolling in a Properzi machine of a 9.5 mm diameter wire rod;
b. solution heat treatment of the machine wire - 3 h at 540 ° C;
c. quenching with cold water;
d. aging for four days at ambient temperature;
e. drawing on a single-pass block to a diameter of 2.2 mm at four successive temperatures — ambient (approximately 20° C), 110° C, 140° C, 160° C.

For drawing at 110° - 140° C and 160° C, the wire is heated before each pass by residence in a thermostatically controlled oil bath, the die also being heated to the drawing temperature.

f. final artificial aging treatment (static furnace) at 165° C for periods ranging from one hour to seven hours.

Variable R — $\rho$ associations were obtained according to the artificial aging times. On the basis of these associations, it is possible to draw curves $R = f(\rho)$ for each drawing temperature. Taking into account only the resistivity value $\rho = 3.25\ \mu\ \Omega$ .cm, the following tensile strength values were obtained:

| Drawing temperature °C | R kg/mm² | $\rho\ \mu\ \Omega$ . cm |
|---|---|---|
| ambient 20° | 35.0 | 3.25 |
| 110° | 37.7 | 3.25 |
| 140° | 39.8 | 3.25 |
| 160° | 38.9 | 3.25 |

EXAMPLE 3

The 2.2 mm diameter wire obtained in accordance with Example 2 by drawing at 140° C was subjected to continuous artificial aging by passage through an oil bath heated to different temperatures, namely 180° C, 200° C and 220° C. The rate of travel of the wire through the bath was such that the residence time at the artificial aging temperature was 15 seconds.

The characteristics obtained for the various artificial aging temperatures and immediately after tepid drawing are as follows:

| Artificial aging temperature in ° C | R Kg/mm² | $A_{200}$% | ρ μ Ω . cm |
|---|---|---|---|
| 180° | 39.1 | 4.5 | 3.255 |
| 200° | 38.5 | 4.5 | 3.243 |
| 220° | 37.4 | 4.5 | 3.228 |
| immediately after tepid drawing | 39.9 | 2.2 | 3.30 |

EXAMPLE 4

Tepid drawing was carried out with three samples of 9.5 mm diameter wire rod corresponding to the compositions A, B and C of Example 1 which had been subjected to the same processing cycle as in that Example, except for the drawing operation which was carried out at 140° C.

As in the preceding Examples, different R — ρ associations were obtained according to the artificial aging conditions. On the basis of these associations, it is possible to draw a curve R — f (ρ) for each alloy, the values of R corresponding to the resistivity value ρ = 3.25 μ Ω .cm being retained. The following results were obtained:

| Alloy | R kg/cm² | $A_{200}$ % | ρμΩ . cm |
|---|---|---|---|
| A | 40 | 5 | 3.25 |
| B (0.05% Cu) | 40.5 | 5 | 3.25 |
| C (0.2% Cu) | 42 | 5 | 3.25 |

EXAMPLE 5

Under otherwise the same conditions as in Example 4, the wire was drawn to a diameter of 3.45 mm with the following results:

| Alloy | R kg/mm² | ρ μ Ω . cm |
|---|---|---|
| A | 38.3 | 3.25 |
| B | 39.1 | 3.25 |
| C | 41 | 3.25 |

EXAMPLE 6

Wires of alloys A and C of Example 1 (respective copper contents < 0.008% and 0.20%) processed in accordance with Example 4, with tepid drawing at 140° C followed by artificial aging in a static furnace, were subjected to various heat treatments in order to characterize the thermal stability of the mechanical characteristics of the wires and their creep resistance.

The mechanical characteristics were measured at 20° C before and after heating for 1 hour at 175° to 200° C and at 250° C and for 100 hours at 125° C. The results obtained were as follows:

| | Alloy A | | Alloy C | |
|---|---|---|---|---|
| Heating | R kg/mm² | $A_{200}$% | R kg/mm² | $A_{200}$% |
| none | 39.5 | 4.8 | 40.8 | 4.0 |
| 1 h at 175° C | 37.1 | 5.7 | 40.2 | 4.0 |
| 1 h at 200° C | 31.6 | 4.8 | 36.1 | 3.7 |
| 1 h at 250° C | 21.7 | 4.5 | 25.7 | 4.5 |
| 100 h at 125° C | 36.4 | 5.4 | 39.8 | 4.0 |

By way of comparison, the 2.2 mm wires of Example 2 processed in accordance with the prior art, with normal drawing at 20° C, gave the following results:

| Heating | R kg/mm² | $A_{200}$% |
|---|---|---|
| None | 35 | 5.5 |
| 1 h at 175° C | 32.8 | 4.5 |
| 1 h at 200 ° C | 28.5 | 4.0 |
| 1 h at 250° C | 18.7 | 6.2 |
| 100 h at 125° C | 33.6 | 6.3 |

The same wires of alloys A and C which had not been heated ("none" line in the preceding Table), were subjected to creep tests over a period of 1000 hours at 60° C under a stress of 7.1 kg/mm². The creep elongations recorded are respectively:

A: 4.55 $10^{-2}$ mm over 125 mm, i.e. ε % = 3.64 $10^{-2}$ %

C: 3.65 $10^{-2}$ mm over 125 mm, i.e. ε % = 2.92 $10^{-2}$ %

In the case of wires similar in their chemical composition to alloy A and processed by conventional methods, the creep elongations obtained under the same test conditions are generally 4 $10^{-2}$ %.

EXAMPLE 7

Using 9.5 mm diameter machine wire, obtained by continuous casting and rolling on a Properzi machine, of two alloys with the following chemical composition:

| | Fe % | Si % | Cu % | Mg % | Ti % |
|---|---|---|---|---|---|
| Alloy E | 0.28 | 0.57 | 0.020 | 0.57 | 0.01 |
| Alloy F | 0.28 | 0.54 | 0.10 | 0.56 | 0.01 |

and having been successively subjected in the form of one ton spools to solution heat treatment for 10 hours at 540° C, quenching with cold water, and drying for 6 hours at 100° C, tepid drawing was carried out in a four-pass drawing machine, the output rate being 100 m/minute. The tepid drawing temperature was 160° C.

The wire enters the machine cold and is brought to the tepid drawing temperature by immersion in the bath of lubricant thermostatically controlled to that temperature, the dies and heads of the drawing machine themselves being immersed in the lubricant.

The 3.45 mm diameter wire obtained in two drawing operations under the above conditions was then subjected to different artificial aging treatments either in a static furnace or by passage through an oil bath.

The mechanical traction characteristics and the electrical resistivity values obtained immediately after tepid drawing and after artificial aging for 12 hours at 150° C are for example as follows:

| Alloy | Artificial aging conditions | R kg/mm² | $A_{200}$% | ρ μ Ω . cm |
|---|---|---|---|---|
| E | Immediately after tepid drawing | 34.7 | 5.7 | 3.447 |
| | After artificial aging for 12 h at 150° C | 38.0 | 8.7 | 3.240 |
| F | Immediately after tepid drawing | 35.6 | 5.3 | 3.480 |
| | After artificial aging for 12 h at 150° C | 39.0 | 8.5 | 3.240 |

EXAMPLE 8

3.45 mm diameter wire obtained as in Example 7 for each of the two alloys was subjected immediately after tepid drawing to a third drawing operation under the same conditions in order to reduce it to a diameter of 2.25 mm.

This wire was also subjected to the artificial aging treatments of Example 7, the corresponding mechanical and electrical characteristics being for example:

| Alloy | Artificial aging conditions | R kg/mm² | $A_{200}$% | ρ μ Ω . cm |
|---|---|---|---|---|
| E | Immediately after drawing | 37.1 | 5.1 | 3.414 |
| | After artificial aging for 12 h at 145° C (static) | 40.0 | 7.8 | 3.240 |
| | After artificial aging for 15 seconds at 230° C (oil bath) | 37.0 | 5.0 | 3.265 |
| F | Immediately after drawing | 38.4 | 5.0 | 3.450 |
| | After artificial aging for 12 h at 145° C (static) | 41.0 | 8.0 | 3.240 |
| | After artificial aging for 15 seconds at 230° C (oil bath) | 37.5 | 5.0 | 3.270 |

The associations of mechanical and electrical characteristics obtained compare favorably with those obtained by conventional industrial processing with drawing at ambient temperature as illustrated in Example 2 in reference to an alloy with a similar composition to alloy E processed by Properzi casting and rolling and then drawn to the same diameter after quenching at the level of 9.5 mm diameter wire rod.

I claim:

1. In a process for producing electrical cables from aluminum-based alloys consisting by weight from 0.15% to 0.35% of iron, from 0.30% to 0.70% of silicon, from 0.30% to 0.80% of magnesium, less than 0.40% of copper, and the remainder being aluminum and usual impurities, comprising the sequential steps of forming said alloy into a wire rod, subjecting said rod to solution heat treatment, quenching of said heat treated rod, drawing the rod into thin wire and artificially aging said wire at a temperature of from 130° to 240° C the improvement comprising said drawing comprising tepid drawing at a temperature of from about 110° C to about 180° C with an elongation of at least 350%, the ultimate tensile strength of the conductors being at least 37 kg/mm², having an elongation at the breaking point of at least 4% and an electrical resistivity of at most 3.28 micro-ohms/centimeter.

2. A process as defined in claim 1 wherein the artificial aging is carried out in a static furnace over a period ranging from thirty minutes to 12 hours at a temperature in the range of from 130° to 170° C.

3. A process as defined in claim 1 wherein the artificial aging is carried out continuously over a period of from one to thirty seconds at a temperature in the range of from 180° to 240° C.

4. A process as defined in claim 1 wherein said tepid drawing is at a temperature of from about 130° C to about 160° C.

5. A process as defined in claim 1 wherein said tepid drawing is at a temperature of about 140° C.

* * * * *